US009732585B2

(12) United States Patent
Lucido et al.

(10) Patent No.: US 9,732,585 B2
(45) Date of Patent: Aug. 15, 2017

(54) TIP-GROUTING TOOLS INCLUDING DISTRIBUTION MATERIALS AND RELATED METHODS

(71) Applicant: SHIMMICK/FCC/IMPREGILO JV, Oakland, CA (US)

(72) Inventors: Rusty Lucido, Salt Lake City, UT (US); Adam Richard Zagorski, Lake Forest, CA (US); Anthony Louis Lucido, Morgan, UT (US); Frank K. Prosser, West Jordan, UT (US); William Allen Corn, Murrietta, CA (US); Chris Howells, Sandy, UT (US); Andrew V. Payne, Cypress, CA (US); Danny Harold Smith, Wittmann, AZ (US); Kent Franklyn Petersen, Huntington Beach, CA (US); Felix Fuentes, West Jordan, UT (US); Blake Daniel McCauley, Francis, UT (US); Alex Gerke, Westminster, CA (US)

(73) Assignee: SHIMMICK/FCC/IMPREGILO JOINT VENTURE, Long Beach, CA (US)

( * ) Notice: Subject to any disclaimer, the term of this patent is extended or adjusted under 35 U.S.C. 154(b) by 210 days.

(21) Appl. No.: 14/521,394

(22) Filed: Oct. 22, 2014

(65) Prior Publication Data

US 2016/0115763 A1 Apr. 28, 2016

(51) Int. Cl.

| | |
|---|---|
| ***E21B 33/13*** | (2006.01) |
| ***E02D 3/12*** | (2006.01) |
| ***E02D 5/30*** | (2006.01) |
| ***E02D 5/62*** | (2006.01) |

(52) U.S. Cl.

CPC ..... *E21B 33/13* (2013.01); *E02D 3/12* (2013.01); *E02D 5/30* (2013.01); *E02D 5/62* (2013.01)

(58) Field of Classification Search

CPC .... E02D 5/30; E02D 5/62; E02D 3/12; E21B 33/13

See application file for complete search history.

(56) References Cited

U.S. PATENT DOCUMENTS

| | | | | |
|---|---|---|---|---|
| 3,241,325 | A * | 3/1966 | Simons | E02D 5/30 405/237 |
| 7,909,541 | B1 * | 3/2011 | Beck, III | E02D 3/12 405/236 |
| 2003/0074777 | A1 * | 4/2003 | McMillan | B63B 21/502 29/428 |
| 2007/0237587 | A1 * | 10/2007 | Mullins | E02D 3/12 405/266 |

OTHER PUBLICATIONS

Mullins et al., Post Grouting Drilled Shaft Tips, Phase I, 2001, 222 pages.

Dapp et al., Tip-Grouted Drilled Shaft Foundations for the Audubon Bridge, 2006, 11 pages.

* cited by examiner

*Primary Examiner* — George Gray
(74) *Attorney, Agent, or Firm* — TraskBritt

(57) ABSTRACT

Tip-grouting tools may include at least one inlet, an outlet in communication with the at least one inlet, and a distribution material defining a tortuous path between the at least one inlet and the outlet. The distribution material may be configured to distribute at least one of pressure, mass, and flow of grouting material across the outlet.

14 Claims, 7 Drawing Sheets

TIP-GROUTING TOOLS INCLUDING DISTRIBUTION MATERIALS AND RELATED METHODS

FIELD

This disclosure relates generally to tip-grouting tools for use with support structures in boreholes in earth formations. More specifically, disclosed embodiments relate to tip-grouting tools configured with a tortuous grout path to more evenly distribute at least one of pressure, mass, and flow of grouting material across outlets of the tip-grouting tools.

BACKGROUND

Tip grouting may be performed on support structures anchored in earth formations. For example, grouting material may be caused to flow under high pressure to a bottom of a support structure positioned in a borehole in an earth formation. The grouting material may densify the earth formation at and around the bottom of the support structure and compress any debris from drilling at the bottom of the borehole.

Tip-grouting tools may be positioned at the bottom of the borehole before formation of the support structure. For example, conduits for grouting material may extend from the surface to the bottom of the borehole, and may remain open after formation of the support structure to enable grouting material to flow through the conduits to the bottom of the support structure. The conduits may simply open to the bottom of the borehole, may be connected to tubing having holes in its sidewalls and rubber sleeves fitted tightly around its outer diameter to cover the holes (i.e., tubes-a-manchette) to enable grouting material to flow out while reducing (e.g., eliminating) the likelihood that other material (e.g., earth formation material and drilling fluids) will enter the tubing through the holes, or may have openings at a back plate to constrain the flow of grouting material toward the bottom of the borehole.

BRIEF SUMMARY

In some embodiments, tip-grouting tools may include at least one inlet, an outlet in communication with the at least one inlet, and a distribution material defining a tortuous path for flow of a grouting material between the at least one inlet and the outlet.

In other embodiments, methods of making tip-grouting tools may involve providing at least one inlet, defining an outlet in communication with the at least one inlet, and positioning a distribution material defining a tortuous path for flow of a grouting material between the at least one inlet and the outlet.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular apparatus or component thereof, but are merely idealized representations employed to describe illustrative embodiments. Thus, the drawings are not necessarily to scale.

The term "grouting material," as used herein, means and includes materials deployed at the bottoms of boreholes in which support structures are located to reinforce earth formations. For example, grouting material includes mixtures of water and cement, which may be further mixed with optional sand, fine gravel, or both.

Grouting material may be forced to the bottom of a borehole at high pressure, such as, for example, a pressure of 300 psi (2.1 MPa), 400 psi (~2.8 MPa), 500 psi (~3.4 MPa), or greater. The high-pressure grouting material may exert pressure directly against the earth formation in which a support structure is located. Though the grouting material is intended to reinforce the earth formation, such as, for example, to reinforce soft formations (e.g., sandstone) or to remediate damage done during drilling of the borehole, the grouting material may, in some instances, further damage the earth formation. For example, grouting material may damage the earth formation when the high pressures of the grouting material are concentrated on small areas at the bottom of the borehole, such as, for example, because the grouting material exits from a small number of orifices, the grouting material exits from orifices of small cross-sectional area, or the grouting material does not diffuse over an entire area of an outlet from a tip-grouting tool. Damaging the earth formation may render the support structure unstable, which may cause any construction resting on the support structure to be unstable, unsafe, or even to fail.

Embodiments within the scope of this disclosure relate generally to tip-grouting tools configured to more evenly distribute pressure and mass of grouting material across outlets of tip-grouting tools. More specifically, disclosed are embodiments of tip-grouting tools including distribution materials to define a tortuous path for grouting material between inlets to the tip-grouting tools and outlets from the tip-grouting tools, which may cause grouting material to be more evenly distributed in terms of both mass and pressure across the outlet.

Figure 1:
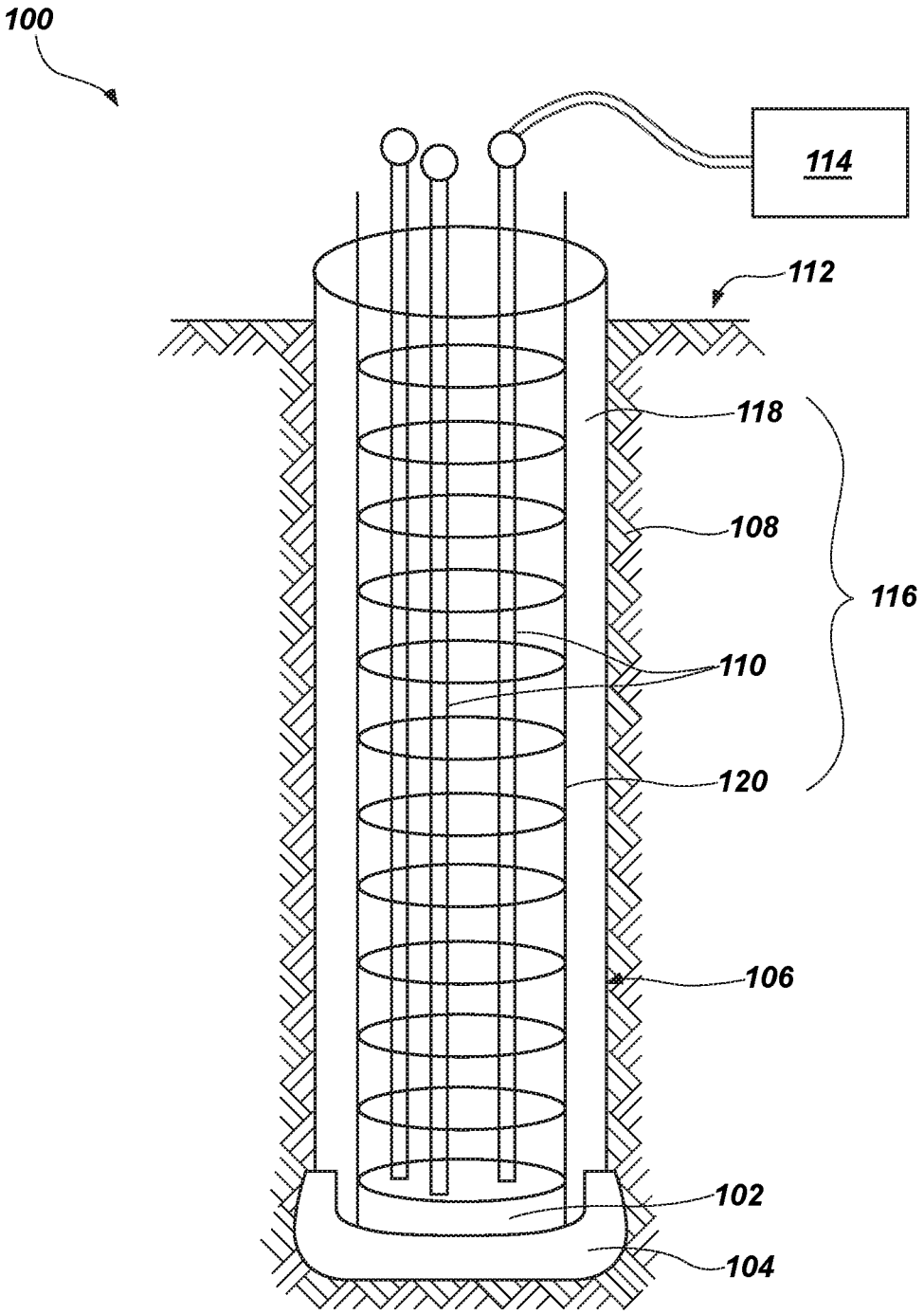
FIG. 1 is a schematic of a tip-grouting system.

Referring to FIG. 1, a schematic of a tip-grouting system 100 is shown. The tip-grouting system 100 may include, for example, a tip-grouting tool 102 configured to discharge grouting material 104 at the bottom of a borehole 106 in an earth formation 108. The tip grouting system 100 may further include hoses 110 (e.g., conduits) connected to the tip-grouting tool 102 and extending from the tip-grouting tool 102 at the bottom of the borehole 106 to the surface 112 of the earth or other grout input location. The hoses 110 may be configured to transmit grouting material 104 from the surface 112 to the tip-grouting tool 102 at the bottom of the borehole 106. For example, a source 114 of grouting material 104 may be connected to the hoses 110. The source 114 may include, for example, a reservoir of grouting material 104 and a pump to pressurize the grouting material 104 and force it down the borehole 104 and into the earth formation 108.

A support structure 116 may be located at least partially in the borehole 106. For example, the support structure 116 may include a pylon 118 (e.g., a column, shaft, or post) configured to provide support to a construction (e.g., a bridge or building). The support structure 116 may further include a support cage 120 configured to reinforce the pylon 118 and embedded within the material of the pylon 118. For example, the support cage 120 may be a lattice (e.g., a web or matrix) of metal reinforcement material (e.g., rebar) configured to strengthen the more brittle material of the pylon 118 (e.g., concrete or cement). The tip-grouting tool 102 may be attached to the support cage 120.

The tip-grouting system 100 may be formed by attaching the tip-grouting tool 102 to an end of the support cage 120. The tip-grouting tool 102 may be connected to the hoses 110, and the tip-grouting tool 102, at least a portion of the support cage 120, and at least some portions of the hoses 110 may be lowered into the borehole 106. The tip-grouting tool 102 may be suspended from the support cage 120 while lowering the tip-grouting tool 102 to the bottom of the borehole 106. When the support cage 120 and tip-grouting tool 102 are in place, the pylon 118 may be formed around the support cage 120, such as, for example, by pouring mixed concrete or pure cement into the borehole 106 and permitting it to cure, to form the support structure 116. Tip-grouting may then be performed to reinforce the earth formation 108 proximate the bottom of the borehole 106 by forcing grouting material 104 from the source 114, through the hoses 110, and out the tip-grouting tool 102 at the bottom of the borehole 106. The grouting material 104 may be forced under pressure. For example, a pressure of the grouting material 104 during tip-grouting may be 300 psi (2.1 MPa) or greater, 400 psi (~2.8 MPa) or greater, or 500 psi (~3.4 MPa) or greater.

Figure 2:
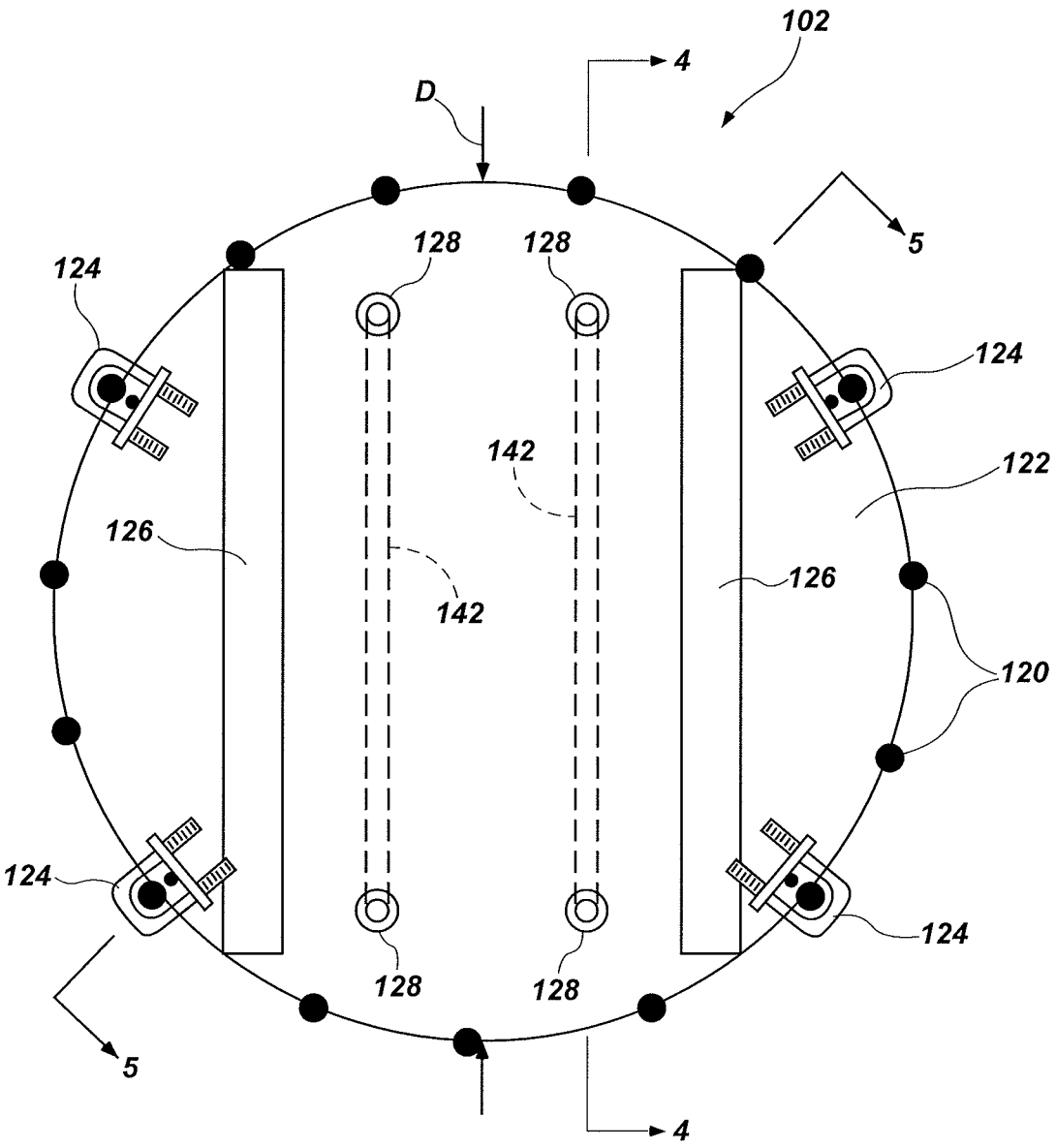
FIG. 2 is a top view of a tip-grouting tool of the tip-grouting system of FIG. 1.

FIG. 2 is a top view of a tip-grouting tool 102 of the tip-grouting system 100 of FIG. 1. The tip-grouting tool 102 may include a back plate 122 on one side (e.g., the top side when the tip-grouting tool 102 is oriented for descent into the borehole 106 (see FIG. 1)) of the tip-grouting tool 102. For example, the back plate 122 may be a metal plate of material sized to fit within the borehole 106. More specifically, the back plate 122 may be a circular, steel plate of a thickness of 0.125 inch (~3.2 mm) or greater (e.g., about 0.25 inch (~6.4 mm)), a diameter D of which may be less than a nominal diameter of the borehole 106. The diameter D of the back plate 122 may be, for example, between 0.5 foot (~0.2 m) and 10 feet (~3.0 m). More specifically, the diameter D of the back plate 122 may be, for example, between 2 feet (~0.6 m) and 8 feet (~2.4 m). As a specific, nonlimiting example, the diameter D of the back plate 122 may be, for example, between 3 feet (~0.9 m) and 7 feet (~2.1 m) (e.g., about 5 feet (~1.5 m)).

In some embodiments, the tip-grouting tool 102 may include connectors 124 configured to connect the tip-grouting tool 102 to the support cage 120. For example, the connectors 124 may be located on the back plate 122 and may be configured to secure members of the support cage 120 to the back plate 122 of the tip-grouting tool 102. As a specific, nonlimiting example, the connectors 124 may be attached to the back plate 122 and may be configured to clamp around the members of the support cage 120 to connect them to the tip-grouting tool 102 (e.g., the connectors 124 may be U-bolts welded to the back plate 122 and having a crossbar to secure the members of the support cage 120 within the U-bolts). In other embodiments, the support cage 120 may be attached to the tip-grouting tool without the use of connectors 124, such as, for example, by welding members of the support cage 120 directly to the tip-grouting tool 102.

In some embodiments, the tip-grouting tool 102 may include at least one spine 126 configured to reinforce the back plate 122. For example, the tip-grouting tool 102 may include a plurality of spines 126, which may be connected to the back plate 122 on one side (e.g., the top side when the tip-grouting tool 102 is oriented for descent into the borehole 106 (see FIG. 1)) and shaped to stiffen the back plate 122. As a specific, nonlimiting example, the tip-grouting tool 102 may include two metal spines 126 (e.g., beams, such as I-beams, L-beams, U-beams, box beams, etc.) attached to the back plate 122 (e.g., by welding), shaped and of a material suitable to stiffen the back plate 122. In other embodiments, the tip-grouting tool 102 may be free of any reinforcing spines 126.

The tip-grouting tool 102 may include one or more inlets 128 sized and positioned to enable grouting material 104 (see FIG. 1) to enter the tip-grouting tool 102. For example, the tip-grouting tool 102 may include a plurality of inlets 128 located on one side (e.g., the top side when the tip-grouting tool 102 is oriented for descent into the borehole 106 (see FIG. 1)) and defining openings through the back plate 122. As a specific, nonlimiting example, the tip-grouting tool 102 may include four inlets 128 (e.g., hose fittings) attached to and extending from the back plate 122 to define openings through which grouting material 104 (see FIG. 1) may enter the tip-grouting tool 102.

Figure 3:
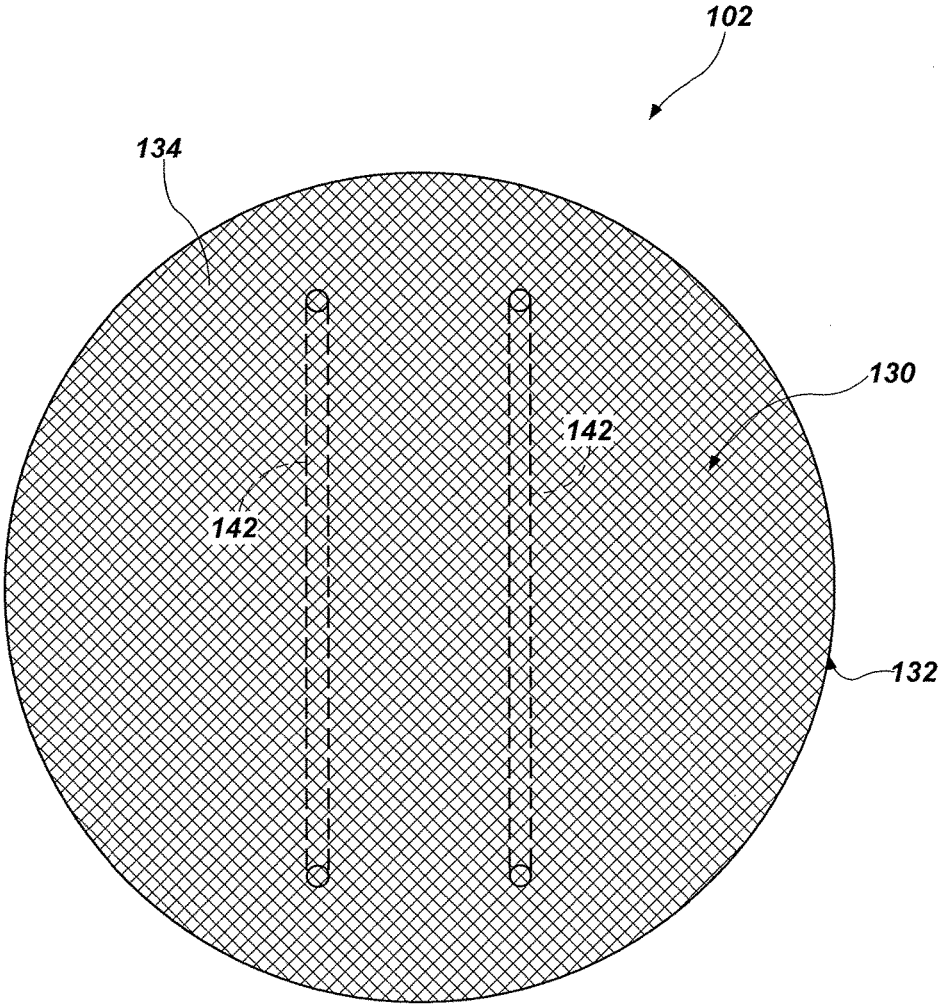
FIG. 3 is, a bottom view of the tip-grouting tool of FIG. 2.

FIG. 3 is a bottom view of the tip-grouting tool 102 of FIG. 2. The tip-grouting tool 102 may include an outlet 130 sized and positioned to enable grouting material 104 (see FIG. 1) to exit the tip-grouting tool 102. For example, the tip-grouting tool 102 may include an outlet 130 located on a side of the tip-grouting tool 102 opposing the back plate 122 (see FIG. 2) (e.g., the bottom side when the tip-grouting tool 102 is oriented for descent into the borehole 106 (see FIG. 1)) exhibiting a cross-sectional area greater than the combined cross-sectional area of the inlets 128 (see FIG. 2). More specifically, the tip-grouting tool 102 may include, for example, one or more outlets 130 at the bottom 132 of the tip-grouting tool 102 through which grouting material 104 may exit the tip-grouting tool 102, and the outlet or outlets 130 may have a total cross-sectional area greater than the combined cross-sectional area of the inlets 128 (see FIG. 2) and less than or equal to the cross-sectional area of the back plate 122 (see FIG. 2). As a specific, nonlimiting example, the tip-grouting tool 102 may include a single, unitary outlet 130 at the bottom 132 of the tip-grouting tool 102 through which grouting material 104 may exit the tip-grouting tool 102, and the outlet 130 may have a total cross-sectional area greater than the combined cross-sectional area of the inlets 128 (see FIG. 2) and at least substantially equal to the cross-sectional area of the back plate 122 (see FIG. 2) (e.g., equal to the cross-sectional area of the back plate 122 minus the cross-sectional area of a side plate 138 (see FIG. 4)).

In some embodiments, the tip-grouting tool 102 may include grating 134 proximate the outlet 130 on the side of the tip-grouting tool 102 opposing the back plate 122 (e.g., the bottom side when the tip-grouting tool 102 is oriented for descent into the borehole 106 (see FIG. 1)). For example, the tip-grouting tool 102 may include grating 134 across an entire cross-sectional area of the outlet 130 on a same side of the tip-grouting tool 102 as the outlet 130 opposing the side on which the back plate 122 is located. As a specific, nonlimiting example, the tip-grouting tool 102 may include metal grating 134 (e.g., a lattice of interconnected wires, a mesh, etc.) defining a plurality of spaces through which grouting material 104 (see FIG. 1) may flow toward the outlet 130 and exit from the tip-grouting tool 102.

Figure 4:
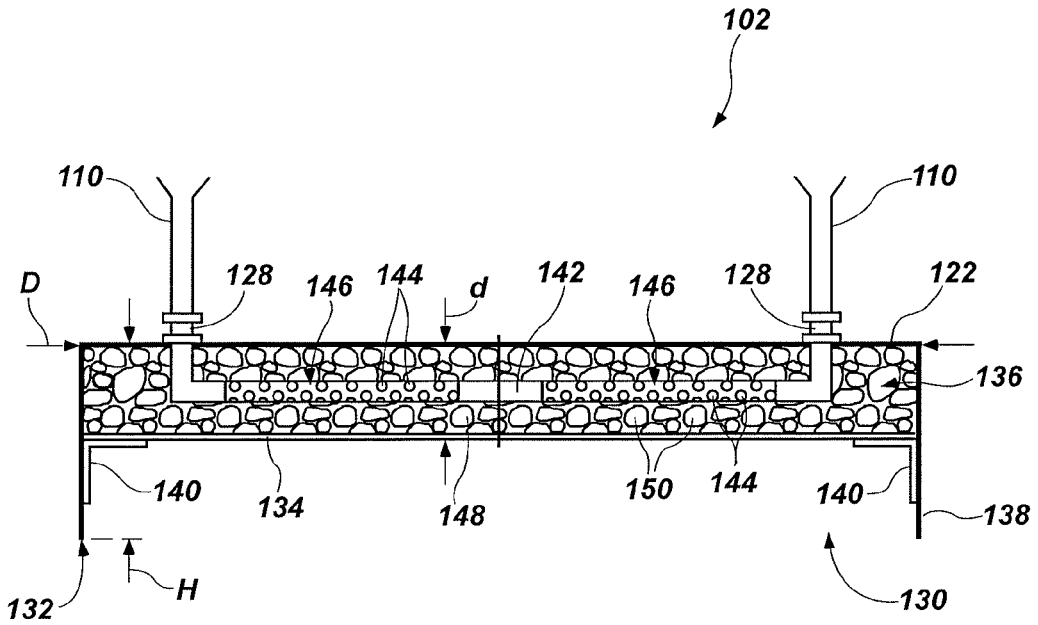
FIG. 4 is a cross-sectional view of the tip-grouting tool of FIG. 2.

FIG. 4 is a cross-sectional view of the tip-grouting tool 102 of FIG. 2 taken along reference line 4-4 (see FIG. 2). The tip-grouting tool 102 may include a space 136 defined between the inlet 128 and the outlet 130. More specifically, a space 136 may be defined between, for example, the back plate 122 and the grating 134.

A side plate 138 may extend from the back plate 122 to the outlet 130. For example, the side plate 138 may extend from a periphery of the back plate 122, past the grating 134, to the outlet 130 to further define the space 136 between the inlet 128 and the outlet 130. More specifically, the side plate 138 may be, for example, a curved sheet of material attached to the periphery of the back plate 122, may define a sidewall to which the grating 134 may be attached, and may extend from the periphery of the back plate 122 to define the outlet 130 at the bottom 132 of the tip-grouting tool 102. As a specific, nonlimiting example, the side plate 138 may be curved sheet metal welded to the back plate 122 at the periphery, may define a sidewall to which the grating 134 may be welded, and may extend from the periphery of the back plate 122 to define the outlet 130 at the bottom 132 of the tip-grouting tool 102.

A height H of the tip-grouting tool 102, as defined between an uppermost surface of the back plate 122 and the lowermost surface of the side plate 138, may be, for example, between 5 inches (~13 cm) and 20 inches (~51 cm). More specifically, the height H of the tip-grouting tool 102 may be, for example, between 7 inches (~18 cm) and 15 inches (~38 cm). As a specific, nonlimiting example, the height H of the tip-grouting tool 102 may be between 8 inches (~20 cm) and 12 inches (~30 cm) (e.g., about 10 inches (~25 cm)).

A distance d between an uppermost surface of the back plate 122 and a lowermost point on the grating 134 may be, for example, less than the height H of the tip-grouting tool 102. More specifically, the grating 134 may be spaced from the outlet 130, such that grouting material 104 (see FIG. 1) exiting the grating 134 must continue to travel some distance before it reaches the outlet 130. In other words, the distribution material 148 may be spaced from the outlet 130, such that the distribution material 148 does not extend to the bottom 132 of the tip-grouting tool 102 in some embodiments. For example, the distance d between the uppermost surface of the back plate 122 and the lowermost point on the grating 134 may be between 2 inches (~5 cm) and 10 inches (~25 cm). More specifically, the distance d between the uppermost surface of the back plate 122 and the lowermost point on the grating 134 may be, for example, between 3 inches (~8 cm) and 8 inches (~20 cm). As a specific, nonlimiting example, the distance d between the uppermost surface of the back plate 122 and the lowermost point on the grating 134 may be between 4 inches (~10 cm) and 6 inches (~15 cm) (e.g., about 5 inches (~13 cm)). In some embodiments, the grating 134 may be located halfway between the back plate 122 and the bottom 132 of the tip-grouting tool 102.

In some embodiments, support members 140 may be positioned on a side of the grating 134 opposing the back plate 122 (e.g., the bottom side when the tip-grouting tool 102 is oriented for descent into the borehole 106 (see FIG. 1)). For example, the support members 140 may reinforce the grating 134 and ensure a more secure connection between the grating 134 and the side plate 138. More specifically, the support members 140 may be attached to both the grating and the side plate 138 to better support the grating 134. As a specific, nonlimiting example, the support members 134 may be metal brackets (e.g., L-brackets) welded to each of the grating 134 and the side plate 138 to better secure the grating 134 in position between the inlet 128 and the outlet 130. In other embodiments, the grating 134 may simply be secured to the side plate 138 without any further reinforcement.

In some embodiments, the tip-grouting tool 102 may include tubing 142 connecting some of the inlets 128 to others of the inlets 128. For example, tubing 142 may extend between pairs of inlets 128 and may include one or more openings 144 through sidewalls of the tubing 142 such that grouting material 104 (see FIG. 1) may flow from the inlets 128, into the tubing 142, and out the openings 144 into the space 136 defined between the inlets 128 and the outlet 130. As a specific, nonlimiting example, the tubing 142 may be a tube-a-manchette extending between each pair of inlets 128, which may include a conduit for grouting material 104 (see FIG. 1), openings 144 from which grouting material 104 (see FIG. 1) may exit, and flexible sleeves 146 (e.g., sleeves of rubber, sleeves of rubber surrounding sheet metal, or other elastically deformable material) covering the openings 144 around a circumference of the tubing 142 such that grouting material 104 (see FIG. 1) may exit the openings 144 under pressure and environmental materials (e.g., fluids used to form the pylon 118 (see FIG. 1) and fluids from the earth formation 108 (see FIG. 1)) are inhibited (e.g., prevented) from entering the openings 144 by the flexible sleeves 146. In embodiments where the total number of inlets 128 is four, such as that shown in FIGS. 2 through 5, two individual sections of tubing 142 may extend between the pairs of inlets 128. In other embodiments, the inlets 128 may open directly into the space 136 between the back plate 122 and the grating 134.

The tip-grouting tool 102 may include a distribution material 148, which may also be characterized as a distribution structure, in the space 136 between the inlet 128 and the outlet 130. The distribution material 148 may define a tortuous path between the inlet 128 and the outlet 130 such that grouting material 104 (see FIG. 1) flowing from the inlet 128 to the outlet 130 may be more evenly distributed across the outlet 130. The distribution material 148 may be, for example, retained in the space 136 defined by the back plate 122, the side plate 138 and the grating 134. More specifically, the distribution material 148 may be positioned in the space 136 adjacent to the back plate 122 and the side plate 138, may substantially surround the tubing 142 within the space 136, and may be retained in the space 136 by the grating 134.

A tortuous flow path may extend throughout the distribution material 148 to cause grouting material 104 (see FIG. 1) to spread itself more uniformly across a cross-sectional area of the outlet 130 as it flows through the distribution material 148. For example, the distribution material 148 may be a porous or discontinuous material defining an interconnected network of spaces through which the grouting material 104 (see FIG. 1) may flow. More specifically, the distribution material 148 may be a mass of gravel located within the space 136 defined between the back plate 122, the side plate 138, and the grating 134, which may define an interconnected network of spaces among individual rock fragments 150 of the mass of gravel through which the grouting material 104 (see FIG. 1) may flow.

In embodiments where the distribution material 148 is a mass of gravel, an average particle size of the rock fragments 150 of the mass of gravel may be greater than an average size of spaces defined by the grating 134 to enable the grating 134 to retain the mass of gravel within the space 136 between the back plate 122, the side plate 138, and the grating 134. For example, the average particle size of the rock fragments 150 may be greater than 1.5 times a maximum distance between members of the grating 134 defining individual spaces of the grating 134. More specifically, the average particle size of the rock fragments 150 may be, for example, greater than 2 times a maximum distance between members of the grating 134 defining individual spaces of the grating 134. The average particle size of the rock fragments 150 may be, for example, two inches or less. More specifically, the average particle size of the rock fragments 150 may be, for example, one-and-a-half inches or less. As a specific, nonlimiting example, the average particle size of the rock fragments 150 may be, for example, one inch or less.

When grouting material 104 (see FIG. 1) flows through the distribution material 148 and out the outlet 130 of the tip-grouting tool 102, the tortuous path taken by the grouting material 104 (see FIG. 1) may cause the mass, pressure, and flow of the grouting material 104 (see FIG. 1) to be more uniformly distributed across the outlet 130 when compared to tip-grouting tools lacking such a distribution material 148. Doing so may result in a more uniform deposit of grouting material 104 (see FIG. 1) into the earth formation 108 (see FIG. 1). In addition, doing so may reduce (e.g., eliminate) the likelihood that the high pressures exerted by the grouting material 104 (see FIG. 1) will be concentrated on a small area of the earth formation 108 (see FIG. 1), which may reduce (e.g., eliminate) the likelihood that the grouting material 104 (see FIG. 1) will damage, crush, or otherwise weaken the earth formation 108 (see FIG. 1).

Figure 5:
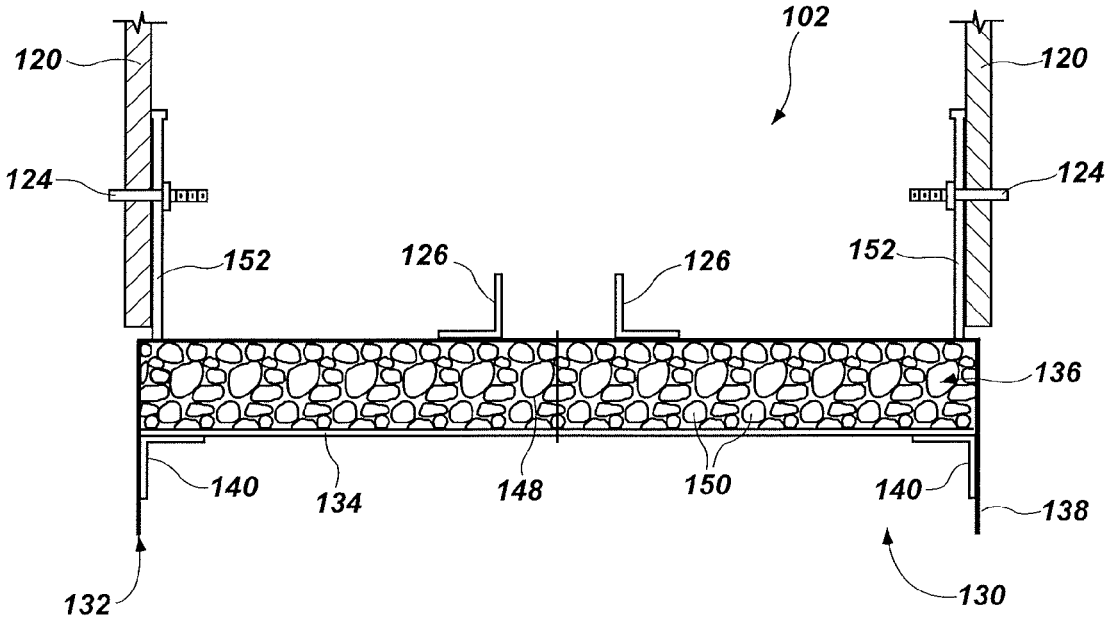
FIG. 5 is another cross-sectional view of the tip-grouting tool of FIG. 2.

FIG. 5 is another cross-sectional view of the tip-grouting tool 102 of FIG. 2 taken along reference line 5-5 (see FIG. 2). In some embodiments, a number of spines 126 configured to stiffen the back plate 122 may be, for example, at least two or greater. For example, the number of spines 126 configured to stiffen the back plate 122 may be between two and six. More specifically, the number of spines 126 configured to stiffen the back plate 122 may be, for example, two or four. In some embodiments, the spines 126 may be located radially farther from a geometric center of the tip-grouting tool 102 than the tubing 142, as shown in FIG. 2. In other embodiments, the spines 126 may be located radially closer to the geometric center of the tip-grouting tool 102 than the tubing 142 (see FIG. 4). In still other embodiments, the spines 126 may alternate with the tubing 142 (see FIG. 4) as distance from the geometric center of the tip-grouting tool 102 increases.

In some embodiments, the connectors 124 may not be directly attached to the back plate 122. For example, the connectors 124 may be attached to rods 152 extending from the back plate 122. More specifically, the connectors 124 may be, for example, welded to metal rods 152 that are, in turn, welded to the back plate 122.

Figure 6:
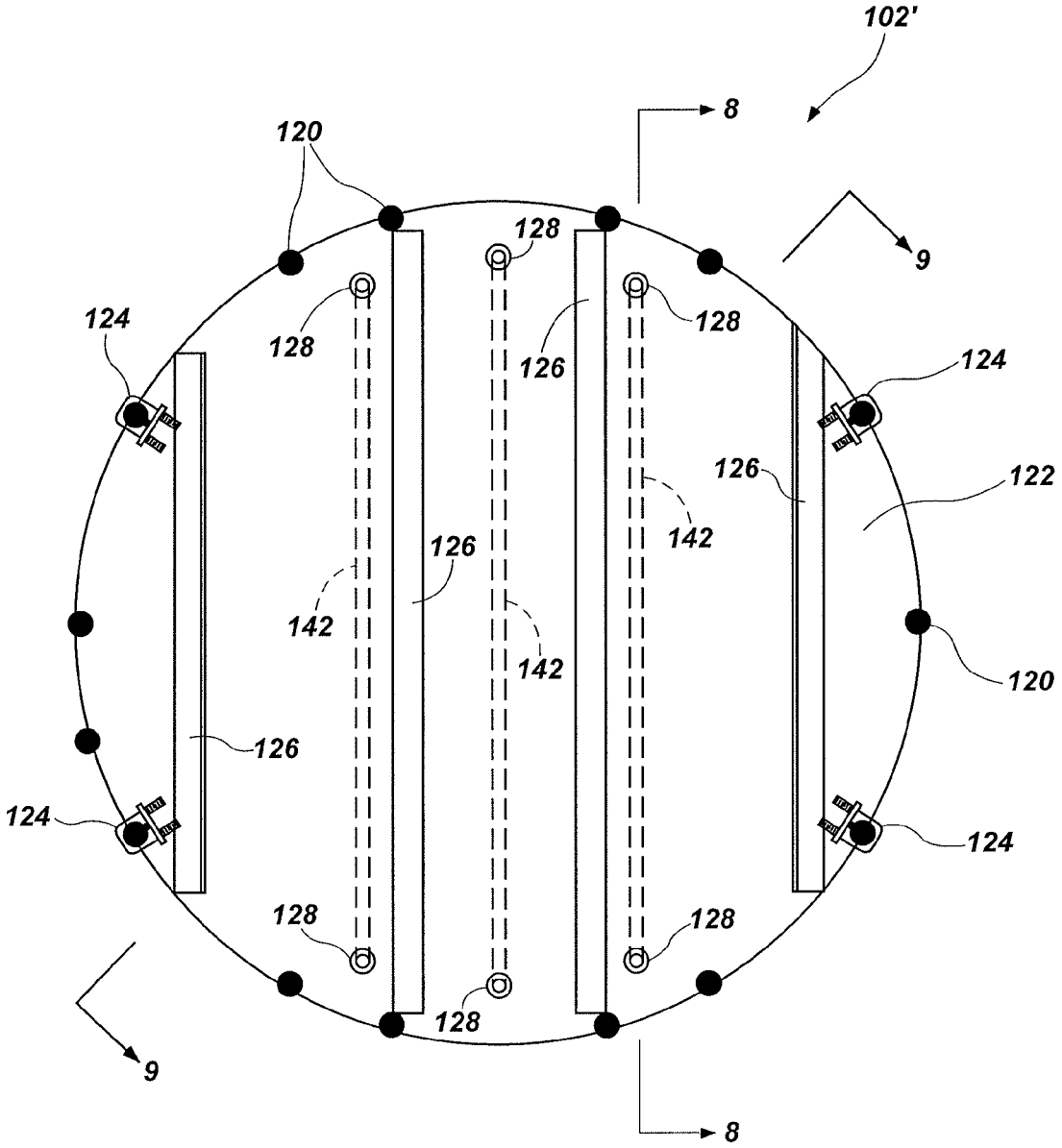
FIG. 6 is a top view of another embodiment of a tip-grouting tool.

FIG. 6 is a top view of another embodiment of a tip-grouting tool 102'. In embodiments where the diameter D of the back plate 122 is large, the tip-grouting tool 102' may accommodate a larger number of inlets 128, sections of tubing 142, and spines 126. For example, a number of inlets 128 may be greater than four. More specifically, the number of inlets 128 may be six or more. As specific, nonlimiting examples, the number of inlets 128 may be six or eight. In some embodiments, the inlets 128 may be collectively referred to as a single inlet for convenience.

Figure 7:
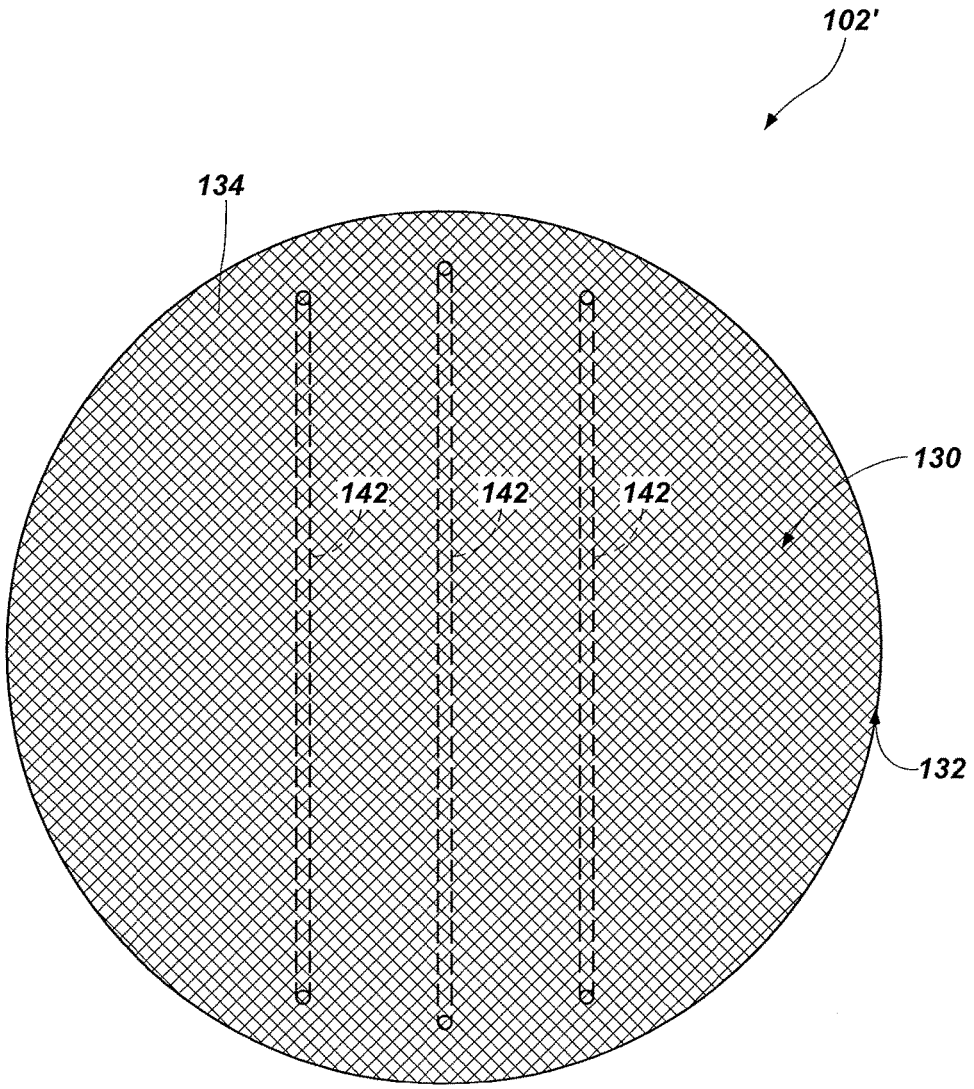
FIG. 7 is a bottom view of the tip-grouting tool of FIG. 6.

FIG. 7 is a bottom view of the tip-grouting tool 102' of FIG. 6. A number of sections of tubing 142 located within the tip-grouting tool 102' may be, for example, greater than two. More specifically, the number of sections of tubing 142 may be three or more. As specific, nonlimiting examples, the number of sections of tubing 142 may be three or four.

In some embodiments, a size of spaces defined by the grating 134 (e.g., a gauge of the grating 134) may remain constant as the diameter D (see FIG. 6) of the back plate 122 increases. For example, the gauge of the grating 134 may be two inches (~5.1 cm) or less, regardless of the size of the back plate 122. More specifically, the gauge of the grating 134 may be, for example, one inch (~2.5 cm) or less, regardless of the size of the back plate 122. As a specific, nonlimiting example, the gauge of the grating 134 may be one-half inch (~1.3 cm) or less, regardless of the size of the back plate 122. In other embodiments, the gauge of the grating 134 may increase proportionally as the diameter D (see FIG. 6) increases.

Figure 8:
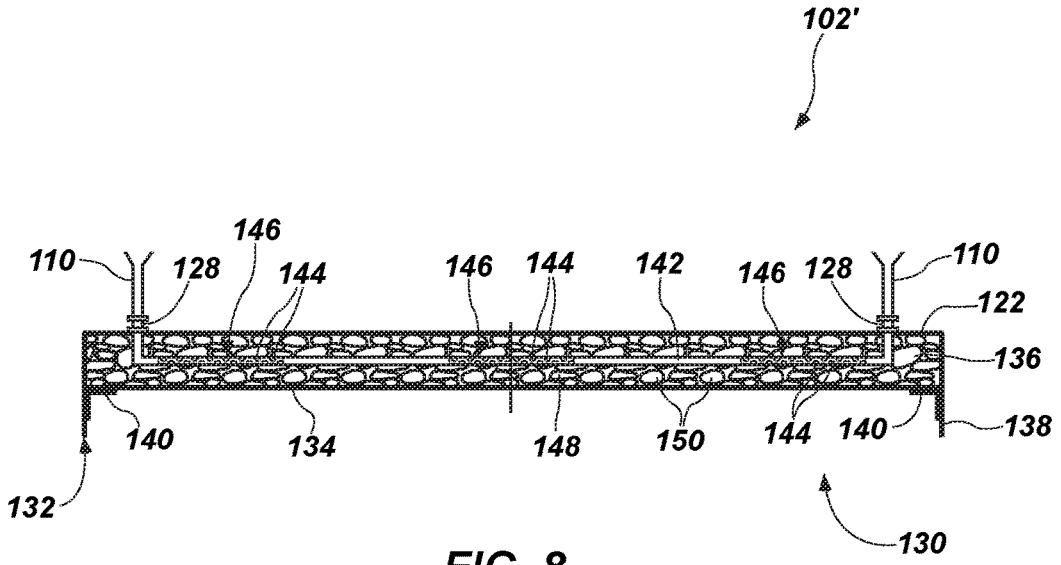
FIG. 8 is a cross-sectional view of the tip-grouting tool of FIG. 6.

FIG. 8 is a cross-sectional view of the tip-grouting tool of FIG. 6. A number of flexible sleeves 146 and corresponding portions of tubing 142 at which openings 144 are located may be, for example, greater than two on each section of tubing 142. More specifically, the number of flexible sleeves 146 and corresponding portions of tubing 142 at which openings 144 are located may be, for example, three or more on each section of tubing 142. As specific, nonlimiting examples, the number of flexible sleeves 146 and corresponding portions of tubing 142 at which openings 144 are located may be three or four on each section of tubing 142.

Figure 9:
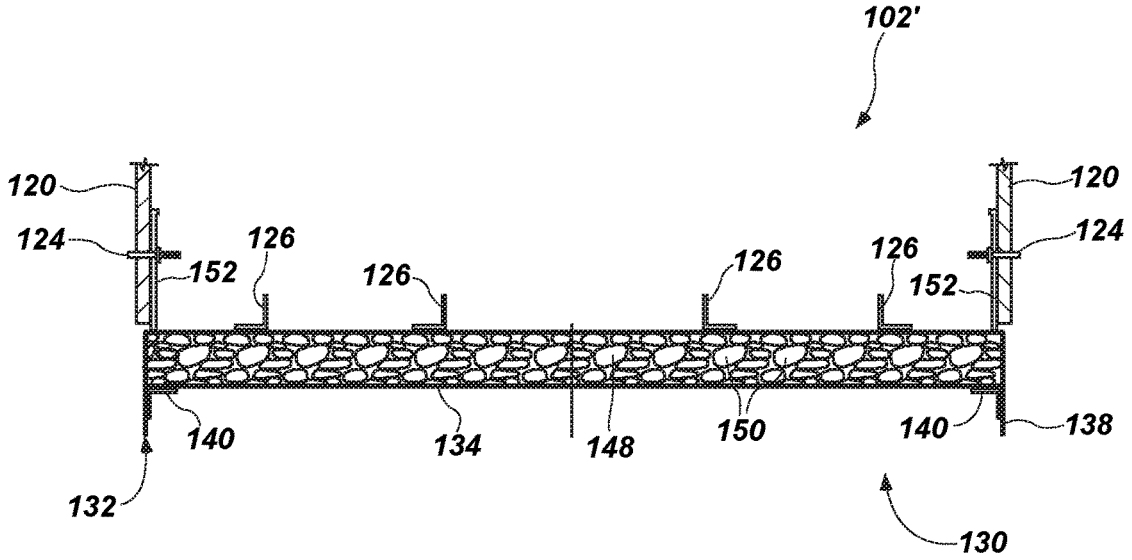
FIG. 9 is another cross-sectional view of the tip-grouting tool of FIG. 6.

FIG. 9 is another cross-sectional view of the tip-grouting tool of FIG. 6. A number of spines 126 configured to reinforce the back plate 122 may be, for example, greater than two. More specifically, the number of spines 126 configured to reinforce the back plate 122 may be, for example, three or more. As specific, nonlimiting examples, the number of spines 126 configured to reinforce the back plate 122 may be four or six.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A tip-grouting tool, comprising:

at least one inlet;

an outlet in communication with the at least one inlet;

a back plate between the at least one inlet and the outlet and at least one side plate extending from the back plate to the outlet;

a latticed grating connected to the at least one side plate proximate the outlet;

a distribution material located between the back plate and the grating, the grating sized to retain the distribution material in a space defined between the back plate and the grating, the distribution material defining a tortuous path for flow of a grouting material between the at least one inlet and the outlet, the grating further sized to allow grout passage therethrough; and at least one tube-a-manchette embedded within the distribution material between the at least one inlet and the outlet.

2. The tip-grouting tool of claim 1, wherein the distribution material comprises a mass of gravel.

3. The tip-grouting tool of claim 2, wherein an average particle size of rock fragments of the mass of gravel is two inches or less.

4. The tip-grouting tool of claim 1, wherein the at least one tube-a-manchette embedded within the distribution material between the at least one inlet and the outlet comprises a plurality of tube-a-manchettes.

5. The tip-grouting tool of claim 1, wherein the at least one inlet comprises hose fittings in communication with each end of the tube-a-manchette.

6. The tip-grouting tool of claim 5, further comprising hoses connected to the hose fittings and sized to extend from a bottom of a borehole to a source of grouting material remote from the tip-grouting tool.

7. The tip-grouting tool of claim 1, wherein the distribution material substantially fills the space between the back plate and the grating to define the tortuous path.

8. The tip-grouting tool of claim 1, further comprising a spine connected to the back plate, the spine being sized and configured to stiffen the back plate.

9. The tip-grouting tool of claim 1, further comprising a support cage attached to the back plate.

10. A method of making a tip-grouting tool, comprising:

providing at least one inlet;

defining an outlet in communication with the at least one inlet;

positioning a back plate between the at least one inlet and the outlet and positioning at least one side plate to extend from the back plate to the outlet;

positioning a distribution material defining a tortuous path for flow of a grouting material between the at least one inlet and the outlet;

embedding a tube-a-manchette within the distribution material between the at least one inlet and the outlet; and connecting a latticed grating to the at least one side plate proximate the outlet, the grating sized to retain the distribution material in a space defined between the back plate and the grating, the grating further sized to allow grout passage therethrough.

11. The method of claim 10, wherein positioning the distribution material between the at least one inlet and the outlet comprises positioning a mass of gravel between the at least one inlet and the outlet.

12. The method of claim 11, wherein positioning the mass of gravel between the at least one inlet and the outlet comprises positioning rock fragments of the mass of gravel exhibiting an average particle size of two inches or less between the at least one inlet and the outlet.

13. The method of claim 10, wherein providing the at least one inlet comprises positioning hose fittings at each end of the tube-a-manchette.

14. The method of claim 10, wherein positioning the distribution material between the at least one inlet and the outlet comprises substantially filling the space between the back plate and the grating with the distribution material to substantially define the tortuous path.

* * * * *